US005117622A

United States Patent [19]

Stahlecker

[11] Patent Number: 5,117,622

[45] **Date of Patent: * Jun. 2, 1992**

[54] FIBER SUPPLY ARRANGEMENT FOR OPEN-END ROTOR SPINNING

[75] Inventor: Fritz Stahlecker, Bad Überkingen, Fed. Rep. of Germany

[73] Assignee: Hans Stahlecker, Fed. Rep. of Germany; a part interest

[ * ] Notice: The portion of the term of this patent subsequent to Nov. 19, 2008 has been disclaimed.

[21] Appl. No.: 518,430

[22] Filed: May 2, 1990

[30] Foreign Application Priority Data

May 18, 1989 [DE] Fed. Rep. of Germany ..... 39162327

[51] Int. Cl.[5] ..... D01H 4/00

[52] U.S. Cl. ..... 57/407; 57/411; 57/413; 57/415

[58] Field of Search ..... 57/300-304, 57/400, 404, 406, 407, 408, 411, 413, 415

[56] References Cited

U.S. PATENT DOCUMENTS

| | | | |
|---|---|---|---|
| 3,511,044 | 5/1970 | Stary | 57/413 X |
| 3,521,440 | 7/1970 | Oskin et al. | 57/405 |
| 3,557,543 | 1/1971 | Krause | 57/413 X |
| 3,604,194 | 9/1971 | Edagawa et al. | 57/413 X |
| 3,834,148 | 9/1974 | Sakurai et al. | 57/413 |
| 3,956,876 | 5/1976 | Artzt et al. | 57/413 |
| 4,459,800 | 7/1984 | Stahlecker | 57/411 |
| 4,479,348 | 10/1984 | Yasui et al. | 57/404 |
| 4,640,090 | 2/1987 | Lembeck | 57/401 |
| 4,769,984 | 9/1988 | Raasch et al. | 57/413 X |
| 4,858,423 | 8/1989 | Stahlecker | 57/411 X |
| 4,903,474 | 2/1990 | Stahlecker | 57/413 |

FOREIGN PATENT DOCUMENTS

| | | |
|---|---|---|
| 3120877 | 12/1982 | Fed. Rep. of Germany . |
| 3704460 | 8/1988 | Fed. Rep. of Germany . |
| 3730706 | 3/1989 | Fed. Rep. of Germany . |

*Primary Examiner*—Daniel P. Stodola
*Assistant Examiner*—Michael R. Mansen
*Attorney, Agent, or Firm*—Evenson, Wands, Edwards, Lenahan & McKeown

[57] ABSTRACT

In an arrangement for open-end rotor spinning having a fiber feeding duct leading from a feeding and opening device to a spinning rotor, it is provided that the fiber feeding duct, at a distance to its mouth, is provided with at least one bypass opening which has a smaller cross-section than the mouth of the fiber feeding duct and which is provided at a point of the fiber feeding duct which has a larger cross-section than the mouth.

19 Claims, 1 Drawing Sheet

FIBER SUPPLY ARRANGEMENT FOR OPEN-END ROTOR SPINNING

BACKGROUND AND SUMMARY OF THE INVENTION

The invention relates to an arrangement for open-end rotor spinning having a spinning rotor which has a fiber sliding surface expanding conically to form a fiber collecting groove. The mouth of a fiber feeding duct is disposed opposite this fiber sliding surface. The fiber feeding duct starts at an opening roller and tapers toward the fiber sliding surface. A cover closes a rotor housing which is connected to a vacuum source which takes in an air current through the fiber feeding duct, the cover having a component in the form of an insert projecting into the spinning rotor. The fiber feeding duct is provided with at least one bypass opening at a distance from the mouth.

In order to ensure optimum spinning conditions, it should be ensured during open-end rotor spinning that the fibers transported in the air current in the fiber feeding duct reach the fiber sliding wall of the spinning rotor, on the one hand, at a sufficient distance from the open end of the spinning rotor and, on the other hand, also at a sufficient distance from the fiber collecting groove. By means of the distance from the open end of the spinning rotor, it is ensured that no fibers are taken along by the transport air flowing off over the open rotor edge. The distance from the fiber collecting groove provides that the fibers can still be stretched on the path taken on the fiber sliding surface leading to the fiber collecting groove. In the case of today's open-end rotor spinning machines, there is a tendency in the direction of progressively smaller spinning rotors so that it becomes more and more difficult to meet the above-mentioned requirements. It is therefore necessary to lead the fibers in a very targeted manner to a certain point of the fiber sliding surface of the spinning rotor which can be achieved mainly by a mouth of the fiber feeding duct with a small cross-section. In this case, there is the danger, however, that because of the small cross-section of the mouth, the amount of the taken-in air current will be reduced so that a perfect fiber transport is not ensured, and there is the additional risk that the opening roller is affected by the fly.

In order to solve the above-described problem, it is known from German patent document DE-37 04 460 Al to enlarge the mouth of the fiber feeding duct in the circumferential direction of the spinning rotor, but to keep it as small as possible transversely to it, i.e., in the axial direction of the spinning rotor.

For the same purpose, it is also known from German patent document DE-37 30 706 Al to open up the fiber feeding duct by means of a lateral slot in the end area opposite the fiber sliding surface so that the cross-section that is essential for the taken-in amount of air is transferred back to an area of the fiber feeding duct with a larger diameter.

It is also known from German patent document DE-31 20 877 Al to separate the transport air before it enters into the spinning rotor from the continuously flying fibers in order to remove fine dirt particles, particularly dust, before the entry into the spinning rotor. In the known construction, the fiber feeding duct, for that reason, is provided with large-surface openings in an area outside the spinning rotor through which the transport air is sucked off.

It is an object of the invention to develop an arrangement of the initially mentioned type in such a manner that a fiber feeding duct is made possible which has a mouth with a small cross-section without resulting in a reduction of the amount of air of the transport air current.

This object is achieved in that the at least one bypass opening has a smaller cross-section than the mouth of the fiber feeding duct and is situated at a point of the fiber feeding duct which has a larger cross-section than the mouth.

By means of this design, it is ensured that, on the one hand, the transport air current flows with a sufficient amount of air without the requirement of increasing the vacuum generated by the vacuum source. On the other hand, it is ensured that a sufficient amount of transport air also flows to the end of the fiber feeding duct and is discharged from the mouth. As a result of the relatively small bypass opening or bypass openings, it is also reliably prevented that fibers are sucked off through it or them. These bypass openings also have the result that the cross-section is enlarged which determines the taken-in amount of air at a given vacuum.

As a further development of preferred embodiments of the invention, it is provided that the sum of the cross-sections of the mouth and of the at least one bypass opening is no larger than the cross-section of the fiber feeding duct at the point of the bypass opening. As a result, it is achieved that the sum of the cross-sections of the mouth and of the bypass opening determine the taken-in amount of air so that it can be apportioned very precisely. In addition, it is also possible, by means of a corresponding dimensioning of the cross-sections of the bypass opening, to provide an overall intake opening which corresponds to the cross-section of the mouth of open-end spinning machines which are customary today and have had good results in practice.

In a further development of preferred embodiments of the invention, it is provided that the fiber feeding duct is provided with several bypass openings arranged symmetrically with respect to the longitudinal axis of the fiber feeding duct. This ensures that the flying direction of the fibers transported in the air current is disturbed as little as possible.

Other objects, advantages and novel features of the present invention will become apparent from the following detailed description of the invention when considered in conjunction with the accompanying drawings.

BRIEF DESCRIPTION OF THE INVENTION

FIG. 1 is a schematic vertical sectional view of an arrangement for open-end rotor spinning, constructed according to a preferred embodiment of the invention; and FIG. 2 is a view of a detail of an arrangement which is slightly modified in comparison to FIG. 1.

DETAILED DESCRIPTION OF THE DRAWINGS

Figure 1:
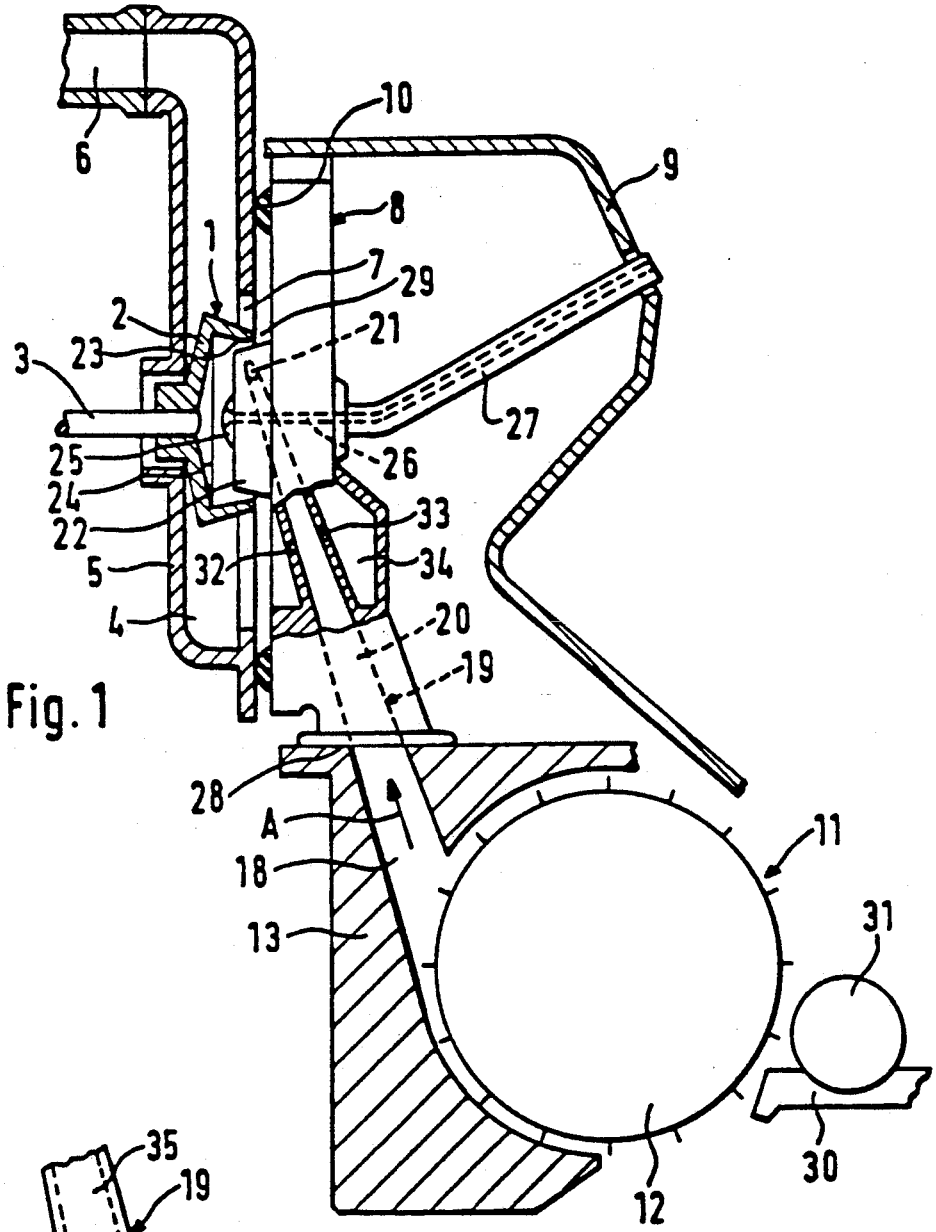

The arrangement for open-end rotor spinning which is shown only schematically in FIG. 1 is a component of an open-end rotor spinning machine which, on both sides of the machine, is equipped with a plurality of arrangements which correspond to one another and are arranged next to one another in a row. Each arrangement contains a spinning rotor 1 which has a rotor dish or disk 2 which is non-rotatably disposed on a shaft 3. The shaft 3 is disposed and driven in a manner not shown in detail. The rotor disk 2 is arranged in a rotor housing 5 which forms a vacuum chamber 4 surrounding the rotor disk 2. By means of a line 6, the rotor housing 5 is connected to a vacuum source which is not shown.

On the side facing away from the shaft 3, i.e., the side corresponding to the open side of the rotor disk 2, the rotor housing 5 is provided with an opening 7. This opening 7 is closed by a cover 8 which rests against the rotor housing 5 by means of a sealing ring 10. The cover 8 is held at a shell 9 of the spinning arrangement which can be swivelled around an axis, which is not shown and which extends in the longitudinal direction of the machine, in such a manner that the spinning rotor 1 is exposed by means of the removal of the cover 8.

The arrangement contains a feeding and opening device 11. This feeding and opening device 11 has a feeding table 30 which, in a manner not shown in detail, is pressed against a drivable feeding roller 31. The feeding roller 31 transports a sliver which is not shown to the circumferential area of an opening roller 12 which, on its circumference, is equipped with a mounting consisting of needles or teeth. The opening roller 12 which is surrounded by a housing 13 combs out the sliver and in the process separates the fibers from the sliver. The separate fibers are fed to the rotor disk 2 of the spinning rotor 1 by means of a fiber feeding duct 19 starting at the opening roller 12.

The fiber feeding duct 19 comprises two sections 18, 20. Section 18 is located in the housing 13 which surrounds the opening roller 12. This section 18 is followed by a section 20 which is a component of the cover 8 which closes off the rotor housing 5. By means of its sliding surface 28, the cover 8 is sealingly connected to the housing 13 of the opening roller 12. Section 20 tapers to its mouth 21 disposed in an insert 22 which projects into the open end of the rotor disk 2. The insert 22 has a shape which tapers slightly conically in the direction of the rotor disk 2. Coaxially to the rotor shaft 3, a yarn withdrawal nozzle 25 is provided in the insert 22 and leads to a yarn withdrawal tube 27 by way of a yarn withdrawal duct 26.

The mouth 21 of the fiber feeding duct 19 is disposed opposite a fiber sliding surface 23 of the rotor disk 2 which expands conically to form a fiber collecting groove 24 of the rotor disk 2. The mouth 21 of the linear fiber feeding duct 19 aimed obliquely into the rotor disk 2 and offset toward the rotor center is disposed opposite the fiber sliding surface 23 at a distance to the open rotor edge and at a distance to the fiber collecting groove 24. A ring gap 29 exists between the insert 22 and the open rotor edge through which the transport air flow is sucked off into the rotor housing 5.

The individual fibers separated from the opening roller 12 are transported in an air current in the direction of the arrow (A) in the fiber feeding duct 19 to the spinning rotor 1. This air current is taken in by way of the vacuum existing in the interior of the rotor disk 2. Normally, the cross-section of the mouth 21 in connection with the applied vacuum determines the amount of air that is taken in this case. Nowadays, the diameter of the rotor disk 2 in the area of the fiber collecting groove 24 measures 30 mm or less. It is therefore necessary that the fed fibers are bundled by means of the fiber feeding duct 19 and are fed to a precisely defined point of the fiber sliding surface 23. On the other side, the fiber feeding duct 19, at the opening roller 12, must start with a cross-section which is adapted to the working width of the opening roller 12. From this relatively large cross-section, the fiber feeding duct 19 then tapers to the mouth 21. In the area of the mouth 21, the cross-section must then be relatively small in order to ensure the punctiform feeding of the fibers. However, in this case, the diameter should not be smaller than 4.5 mm so that a secure fiber passage is ensured. However, because of the desired small cross-section of the mouth, there is the danger that no sufficient amount of air is taken in which ensures a secure fiber transport and which also prevents that fly occurs in the area of the opening roller 12. Although the vacuum in the rotor housing 5 could be increased, this would lead to an increased consumption of energy and, under certain circumstances, also to an increased fiber speed.

In order to generate a sufficient amount of air in the fiber feeding duct 19 despite the small cross-section of the mouth without an increase of the vacuum, it is provided that the fiber feeding duct 19, in the area of section 20, is provided with one or several bypass openings 32, 33. These bypass openings 32, 33 are located in a chamber 34 of the cover 8 which are open in the direction of the rotor housing 5 so that the vacuum generated by the vacuum source is also applied to the bypass openings 32, 33. The bypass openings 32, 33 are located at a point of the fiber feeding duct 19 which has a larger cross-section than the mouth 21. The bypass openings 32, 33 which are provided at a distance of approximately 30 mm to approximately 40 mm from the mouth 21 have a smaller cross-sectional surface than the mouth 21. Advantageously, it is provided that the sum of the cross-sectional surfaces of the mouth 21 and of the bypass openings 32, 33 is smaller than the cross-sectional surface of the point of the fiber feeding duct 19 where the bypass openings 32, 33 are located. Thus, this sum of cross-sections determines the intake cross-section.

In order to prevent that fibers are sucked off by way of the bypass openings 32, 33, their cross-section is kept as small as possible; i.e., it should not exceed 7 $mm^2$. In this case, it is provided that particularly their dimensions in the longitudinal direction of the fiber feeding duct 19 are limited to maximally 3 mm. In the case of round bypass openings 32, 33, a maximal diameter of 3 mm is therefore provided.

In order not to deflect the fibers by the sucking-off of transport air by way of the bypass openings 32, 33, it is advantageous for the bypass openings 32, 33 to be arranged symmetrically with respect to the longitudinal axis of the fiber feeding duct 19. It is also provided that the bypass openings 32, 33 are aligned perpendicularly with respect to the longitudinal direction of the fiber feeding duct 19 or, if necessary, with one component in the longitudinal direction of the fiber feeding duct 19 so that the transport air, in the area of the bypass openings 32, 33, with one component, is sucked off against the transport direction of the fibers.

Figure 2:
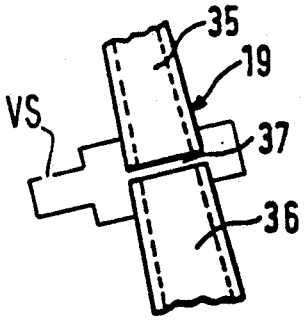

In the embodiment according to FIG. 2, it is provided that a circular-slot-type interruption in the fiber feeding duct 19 is provided as the bypass opening 37 and, in this area, is divided into two sections 35, 36. In this manner, a relatively large cross-sectional surface will be achieved without the requirement that the width of the annular gap 37 must be large in the longitudinal direction of the fiber feeding duct 19. A maximal width of 2 mm is definitely sufficient.

In order to achieve that proportionately no more air is discharged through the bypass opening 32, 33 or 37 than through the mouth 21, it is endeavored that the vacuum which, on the inside of the bypass opening 32, 33; 37, affects the interior of the duct is at least approximately equal to the vacuum which exists directly behind the bypass opening 32, 33; 37 in the duct section extending from there to the mouth 21. In a first embodiment, this is achieved in that the duct section, starting from the mouth 21 to relatively closely to the area of the bypass opening 32, 33; 37, has a cylindrical or largely cylindrical construction.

In another embodiment, it is provided for the same purpose that the bypass opening 32, 33; 37 is applied to a separate vacuum source (BS schematically depicted in dash line in FIG. 2) so that a reduced vacuum is applied here. In another embodiment, it is provided that the bypass opening 32, 33; 37 is constructed and/or dimensioned such that at least approximately the same pressure losses occur in it which also occur in the section between the bypass opening 32, 33; 37 and the mouth 21 of the fiber feeding duct 19. It may be provided in this case, for example, that the bypass opening 32, 33; 37 widens from the outside toward the inside at the same proportion as the widening occurring between the mouth 21 of the fiber feeding duct 19 and the point at which the bypass openings 32, 33; 37 are provided. For example, in the embodiment according to FIG. 2, this could be implemented in that the boundary walls of the circular slot 37 are constructed to be oblique so that the cross-section of the circular slot 37 widens from the outside toward the inside. However, in another embodiment, the pressure losses may also be determined by maintaining a given ratio between the cross-section and the length of the bypass openings 32, 33; 37.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An arrangement for open-end rotor spinning comprising:

a spinning rotor which has a fiber sliding surface expanding conically toward a fiber collecting groove, a fiber feeding duct with a mouth disposed opposite this fiber sliding surface and the fiber feeding duct starting at an opening roller and tapering toward the fiber sliding surface, an insert projecting into the spinning rotor which is a component of a cover which closes a rotor housing which is connected to a vacuum source which takes in a fiber transport air current through the fiber feeding duct, wherein the fiber feeding duct is provided with at least one bypass opening spaced from the mouth in an area located outside the rotor, the at least one bypass opening having a smaller cross-section than the mouth of the fiber feeding duct and being provided at a point of the fiber feeding duct which has a larger cross-section than the mouth, and a vacuum source connected to the at least one bypass opening for sucking off a portion of the fiber transport air current upstream of the rotor to thereby facilitate an increase in the flow of fiber transport air current upstream of the rotor.

2. An arrangement according to claim 1, wherein the sum of the cross-sections of the mouth and of the at least one bypass opening is no larger than the cross-section of the fiber feeding duct at the point of the bypass opening.

3. An arrangement according to claim 2, wherein the cross-section of the bypass opening is approximately half as large as the cross-section of the mouth of the fiber feeding duct.

4. An arrangement according to claim 1, wherein the cross-section of the bypass opening is approximately half as large as the cross-section of the mouth of the fiber feeding duct.

5. An arrangement according to claim 1, wherein the cross-section of the at least one bypass opening is no larger than approximately 7 $mm^2$.

6. An arrangement according to claim 5, wherein the cross-section of the mouth of the fiber feeding duct is no larger than 16 $mm^2$.

7. An arrangement according to claim 6, wherein the at least one bypass opening is arranged at a distance of approximately 30 mm to 40 mm from the mouth of the fiber feeding duct.

8. An arrangement according to claim 7, wherein the fiber feeding duct is provided with several bypass openings arranged symmetrically with respect to the longitudinal axis of the fiber feeding duct.

9. An arrangement according to claim 7, wherein the bypass opening has the shape of a circular slot.

10. An arrangement according to claim 1, wherein the cross-section of the mouth of the fiber feeding duct is no larger than 16 $mm^2$.

11. An arrangement according to claim 1, wherein the at least one bypass opening is arranged at a distance of approximately 30 mm to 40 mm from the mouth of the fiber feeding duct.

12. An arrangement according to claim 1, wherein the fiber feeding duct is provided with several bypass openings arranged symmetrically with respect to the longitudinal axis of the fiber feeding duct.

13. An arrangement according to claim 1, wherein the bypass opening has the shape of a circular slot.

14. An arrangement according to claim 1, wherein the bypass opening is located in the area of a chamber of the cover which surrounds the fiber feeding duct, this chamber being connected to a vacuum source.

15. An arrangement according to claim 14, wherein the chamber is open in the direction of the rotor housing.

16. An arrangement according to claim 1, wherein in the interior of the fiber feeding duct at the bypass opening. there exists at least approximately the same vacuum which exists at the inlet into the remaining section of the fiber feeding duct leading to the mouth.

17. An arrangement according to claim 16, wherein the bypass opening is connected to a separate vacuum supply device.

18. An arrangement according to claim 16, wherein the bypass opening and the mouth of the fiber feeding duct are connected to the same vacuum source, and wherein the bypass opening is constructed and/or dimensioned such that at least approximately the same pressure losses occur in it as in the remaining section extending from the bypass opening to the mouth of the fiber feeding duct.

19. An arrangement according to claim 1, wherein the bypass opening and the mouth of the fiber feeding duct are connected to the same vacuum source, and wherein the bypass opening is constructed and/or dimensioned such that at least approximately the same pressure losses occur in it as in the remaining section extending from the bypass opening to the mouth of the fiber feeding duct.

* * * * *